US006966205B2

(12) United States Patent
Devecki

(10) Patent No.: US 6,966,205 B2
(45) Date of Patent: Nov. 22, 2005

(54) SCUBA TANK LOCK ASSEMBLY

(76) Inventor: Ronald W. Devecki, 2674 Kirk Rd., West Palm Beach, FL (US) 33406

( * ) Notice: Subject to any disclaimer, the term of this patent is extended or adjusted under 35 U.S.C. 154(b) by 0 days.

(21) Appl. No.: 11/007,532

(22) Filed: Dec. 7, 2004

(65) Prior Publication Data

US 2005/0081579 A1 Apr. 21, 2005

Related U.S. Application Data

(63) Continuation-in-part of application No. 10/666,186, filed on Sep. 17, 2003, now Pat. No. 6,829,916.

(51) Int. Cl.[7] ..... E05B 73/00
(52) U.S. Cl. ..... 70/18; 70/58
(58) Field of Search ..... 70/14, 18, 30, 70/49, 58, 233; 248/551–553

(56) References Cited

U.S. PATENT DOCUMENTS

| | | | | | |
|---|---|---|---|---|---|
| 1,274,203 | A * | 7/1918 | Sager et al. | 211/4 |
| 3,101,695 | A * | 8/1963 | Honeyman, Jr. | 114/230.29 |
| 3,841,118 | A * | 10/1974 | Stone | 70/33 |
| 3,859,826 | A * | 1/1975 | Singer et al. | 70/58 |
| 3,987,653 | A * | 10/1976 | Lyon et al. | 70/19 |
| 4,003,228 | A * | 1/1977 | Lievens et al. | 70/58 |
| 4,055,973 | A * | 11/1977 | Best | 70/58 |
| 4,212,175 | A * | 7/1980 | Zakow | 70/58 |
| 4,570,465 | A * | 2/1986 | Bennett | 70/18 |
| 4,573,584 | A * | 3/1986 | Otema | 211/4 |
| 4,598,827 | A * | 7/1986 | Keifer | 211/4 |
| 4,733,840 | A * | 3/1988 | D'Amore | 248/205.3 |
| 4,979,382 | A * | 12/1990 | Perry | 70/58 |
| 5,154,072 | A * | 10/1992 | Leyden | 70/18 |
| 5,351,507 | A * | 10/1994 | Derman | 70/18 |
| 5,398,530 | A * | 3/1995 | Derman | 70/58 |
| 5,481,888 | A * | 1/1996 | Perry | 70/18 |
| 6,003,348 | A * | 12/1999 | McCrea | 70/18 |
| 6,167,734 | B1 * | 1/2001 | Derman | 70/18 |
| 6,212,919 | B1 * | 4/2001 | Gerow | 70/18 |
| 6,829,916 | B1 * | 12/2004 | Devecki | 70/18 |

* cited by examiner

*Primary Examiner*—Lloyd A. Gall
(74) *Attorney, Agent, or Firm*—McHale & Slavin, P.A.

(57) ABSTRACT

A scuba tank locking device includes a cable lock and a locking plate having a first aperture sized to receive the cable lock and a second aperture having an elongated slot extending therefrom. A key-operated tumbler lock is tangentially adjacent the second aperture and includes a coaxial bolt member operatively associated therewith positionable between locked and unlocked positions, with the bolt member extending into the second aperture in the locked position. An attachment cable formed from flexible steel cable is permanently attached to the steel plate with a distal end being sized for insertion through the second aperture and subsequent placement within the slot. The attachment cable includes a coaxially attached locking lug sized for insertion into the second aperture and having a width greater than the width of the slot. The bolt member prevents the withdrawal of the locking lug when in the locked position.

21 Claims, 5 Drawing Sheets

SCUBA TANK LOCK ASSEMBLY

RELATED APPLICATIONS

This invention is a continuation-in-part of application Ser. No. 10/666,186 filed Sep. 17, 2003 now U.S. Pat. No. 6,829,916, the contents of which are incorporated herein by reference.

FIELD OF THE INVENTION

The invention relates to locking devices, and more particularly to a locking device for use with diving equipment.

BACKGROUND OF THE INVENTION

Recreational and professional scuba divers require numerous accessories for underwater exploring and/or work. The accessories include air tanks, weights, buoyancy compensators, computers, wet suits, float balls/flags, and so forth. All such accessories are necessary for a safe dive and typically consist of the latest in technology. Thus, even if older equipment is used it is meticulously maintained since any failure could result in injury or death. For this reason, most any accessory used in diving is very expensive and, due to the portability of the profession, easily transported.

While many of the accessories can be hidden from the view of a potential thief, some of the accessories are impractical to conceal due to size, weight, space considerations or the inherent dangers associated with concealing some of the items. For instance, scuba tanks are commonly left on the deck of a boat due to problems in storage. Since scuba tanks are expensive and easily moved they make for easy prey by thieves.

Scuba tanks may be left on a deck of a boat due to lack of storage space but more commonly are left on the deck due to dangers associated with attempting to conceal scuba tanks. Scuba tanks are very heavy, weighing approximately 40 pounds when fully charged and contain 3000 pounds per square inch of compressed air. At the upper end of a scuba tank there is a K-valve that should it be broken off, the compressed air would project the K-valve flying at a velocity sufficient to cause death or serious injury to a person struck by it. Consequently, tanks are typically stored in the vertical position in the cockpit of a boat in a holder commonly referred to as a tank rack.

The amount of compressed air utilized by a scuba diver in the course of his underwater activities depends on the depth at which he is diving; greater amounts of air are utilized at greater depths. However, on the average, a diver will utilize a full tank of air in 30–40 minutes. For this reason, a diver will typically employ at least two tanks for any diving expedition. Since it is most unsafe to dive alone, a diver typically travels with at least one other diver which results in at least four scuba tanks that could be stolen if unattended.

There are various known tank racks that are designed to secure a particular size tank and may include provisions for locking of the scuba tanks. The following patents provide examples of scuba tank racks: U.S. Pat. Nos. 3,791,403; 2,122,897; 3,193,778; 3,860,048; 3,693,830; and 1,174,185.

In addition, cable locking devices are known in the art. For instance, Stone, U.S. Pat. No. 3,841,118 discloses a cable lock designed to facilitate locking motorcycles, bicycles, snowmobiles and outboard motors to a post or tree to prevent theft. The cable lock includes an elongated cable and a pair of mating block sections with means for securely locking the same around the cable to form a positively locked loop.

McCrea, U.S. Pat. No. 6,003,348, discloses a cable lock for surfboards. A sleeve fitting is swaged to a length of cable such that a loop is formed at the end of cable. This loop is used to secure the cable to a rack or other stationary component. A block is used to retain the cable around the object itself. The cable passes through a hole in one end of the block, wraps around the object, and slides into a slot in the other end of the block. An end fitting swaged to the cable prevents the cable from sliding out of the slot in a parallel direction. A padlock is used to prevent the cable from sliding out of the slot in a perpendicular direction. A setscrew is used to retain the block to the cable in the desired location.

Lyon et al, U.S. Pat. No. 3,987,653, disclose a locking device for a looped cable which includes a casing in which one end of the cable is anchored and a passageway through the casing through which the other end of the cable can be passed. Within the casing is a cable clamp for reducing the size of the passageway, the clamp being threaded on a screw and movable to change the size of the passageway by rotation of the screw. The screw is rotatable by rotation of a lock mounted in the casing, the lock being rotatable by a key. The clamp cooperates with a bed to define the passageway, the clamp and bed having intercalated pyramidal teeth which can exert a vise-like grip on a cable of normally cylindrical shape.

Gerow, U.S. Pat. No. 6,212,919, discloses an adjustable cable loop locking system for securing two spaced apart articles, such as a boat to dock piling, with a length of flexible cable. The system includes first and second mechanisms slidably disposed on opposite end portions of a cable in which are formed first and second cable loops respectively. A flexible sheath, which may be a conventional hollow hydraulic hose, slidably covers a central portion of cable and is affixed on opposite ends thereof to the first and second mechanisms to fix the distance between the mechanism as measured along the central portion of the cable. The two lead-in portions of the first loop slidably extend through the first mechanism except that one of these lead-in portions which contains a free end of the cable can be selectively locked in a stationary position in the first mechanism by operation of a locking handle when desired. One of the lead-in portions of the second loop which extends from the first mechanism extends slidably through the second mechanism to the second loop, the end of the cable at the end of the second loop being fastened in the second mechanism. The arrangement permits securing two spaced apart articles together while needing to lock only the first of the two mechanisms.

Zakow, U.S. Pat. No. 4,212,175, discloses a lock for items of portable personal property. The lock includes a plurality of cables extending from a locking box which is mountable to a mounting surface. The items of personal property are mounted to the cables, and at least one end of each cable is secured to one of a plurality of nipples disposed within the box. The locking box has an inner box member and an outer box member which are matable to form the box; the width of the opposed side walls of both the inner box member and the outer box member are generally equal, so that jimmying, or forced opening of the box is precluded since the free edges of the side walls of the outer box member are contiguous with the fixed planar surface when the assembled box is mounted to the surface.

Best, U.S. Pat. No. 4,055,973, discloses an equipment lock for laboratory or office equipment and the like. To prevent removal of the items, separate cables are attached to four or more items of such equipment and have. circumferentially-grooved end members which are received in separate bores in a single lock body and are locked therein by a key-controlled keeper. The keeper is a key-removable core inserted in a core chamber which partially intersects the cable-receiving bores, so that the core itself engages in the grooves of the cable end members to lock them against retraction. A mounting screw access passage traverses the core chamber, and is blocked by the core in such chamber to prevent access to a mounting screw inserted through such passage.

Leyden, U.S. Pat. No. 5,154,072, discloses a cable lock for securing a plurality of cables having a blocking shoulders on the ends. The cable lock has openings dimensioned to receive the cable shoulders. A cover is mounted for selective movement relative to the housing between a position permitting passage of the cable through the opening to a position preventing passage of the cable through the opening. The housing is secured with a key operated tumbler lock.

Keifer, U.S. Pat. No. 4,598,827, discloses a system for securing display items to a fixture or the like comprising a housing adapted to be secured to the fixture and a plurality of elongated cables for securing the display items to the fixture. Each cable has a means at one end for securing it to the display item and is detachably secured in the housing at its opposite end. The housing includes cable retention and release channels for a plurality of cables. The channels have an enlarged entrance portion and are configured to permit insertion and removal of the opposite ends of the cables so that any one of the cables may be inserted or removed individually. The housing includes a locking means blocking the entrance portion of the channels and a second position permitting removal of the cables.

However, what is lacking in the art is the ability to securely lock single, or a plurality, of scuba tanks to most any tank rack or fixed object as well as secure various accessories.

SUMMARY OF THE INVENTION

In one embodiment, the accessory locking device of the invention comprises an elongated securement means such as a chain or cable having one end securable to a fixed structure and a second end which can receive a padlock, and a locking plate assembly including a steel locking plate having a first aperture sized to receive the chain or cable and a second centrally positioned aperture having an elongated slot extending therefrom. A key-operated tumbler lock is tangentially adjacent the second aperture and includes a coaxial bolt member operatively associated therewith positionable between locked and unlocked positions, with the bolt member extending into the second aperture in the locked position. The locking plate assembly includes at least one attachment cable formed from flexible steel cable which is permanently attached to the steel plate with a distal end being sized for insertion through the second aperture and subsequent placement within the slot. The at least one attachment cable includes a coaxially attached locking lug sized for insertion into the second aperture and having a width greater than the width of the slot. The locking lug can be positioned at the distal end of the attachment cable and formed as a handle which facilitates grasping the flexible cable and positioning thereof. In use, the bolt member of the key-operated tumbler lock is placed in an unlocked position, and the distal end of the at least one attachment cable is wrapped around an item to be locked and inserted into the second aperture of the locking plate such that the locking lug passes through the second aperture and the at least one attachment cable is transversed for placement into the slot. Then, the bolt member of the key-operated tumbler lock is placed in a locked position thus preventing the withdrawal of the locking lug from the aperture. The chain or cable is then inserted through the first aperture leaving the insertion end available for receipt of a padlock and the attachment end is secured to a stationary structure, thereby locking the item to the stationary structure. In alternative embodiments, a padlock can be inserted through the first and second apertures to prevent the withdrawal of the locking lug from the aperture.

It is an objective of the invention to provide an inexpensive, durable, reliable, and portable means of locking scuba tanks.

It is another objective of the invention to provide a locking device which can conveniently lock scuba tank accessories such as weights, regulators, gauge units, buoyancy compensators, and the like accessories.

It is another objective of the invention to provide a locking device wherein scuba tanks can be securely locked without the necessity of making precise tank positioning adjustments.

Still another objective of the invention is to provide a scuba lock system that can quickly and safely secure scuba tanks and gear, either on the dock, in a vehicle, or anywhere that opportunistic theft is a possibility.

Another objective of the invention is to provide a locking device that can lock scuba tanks of various heights and diameters.

Yet another objective of the invention is to provide a locking device which simultaneously secures a plurality of scuba tanks to a fixed structure, and which also allows individual tanks to be selectively locked and unlocked.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
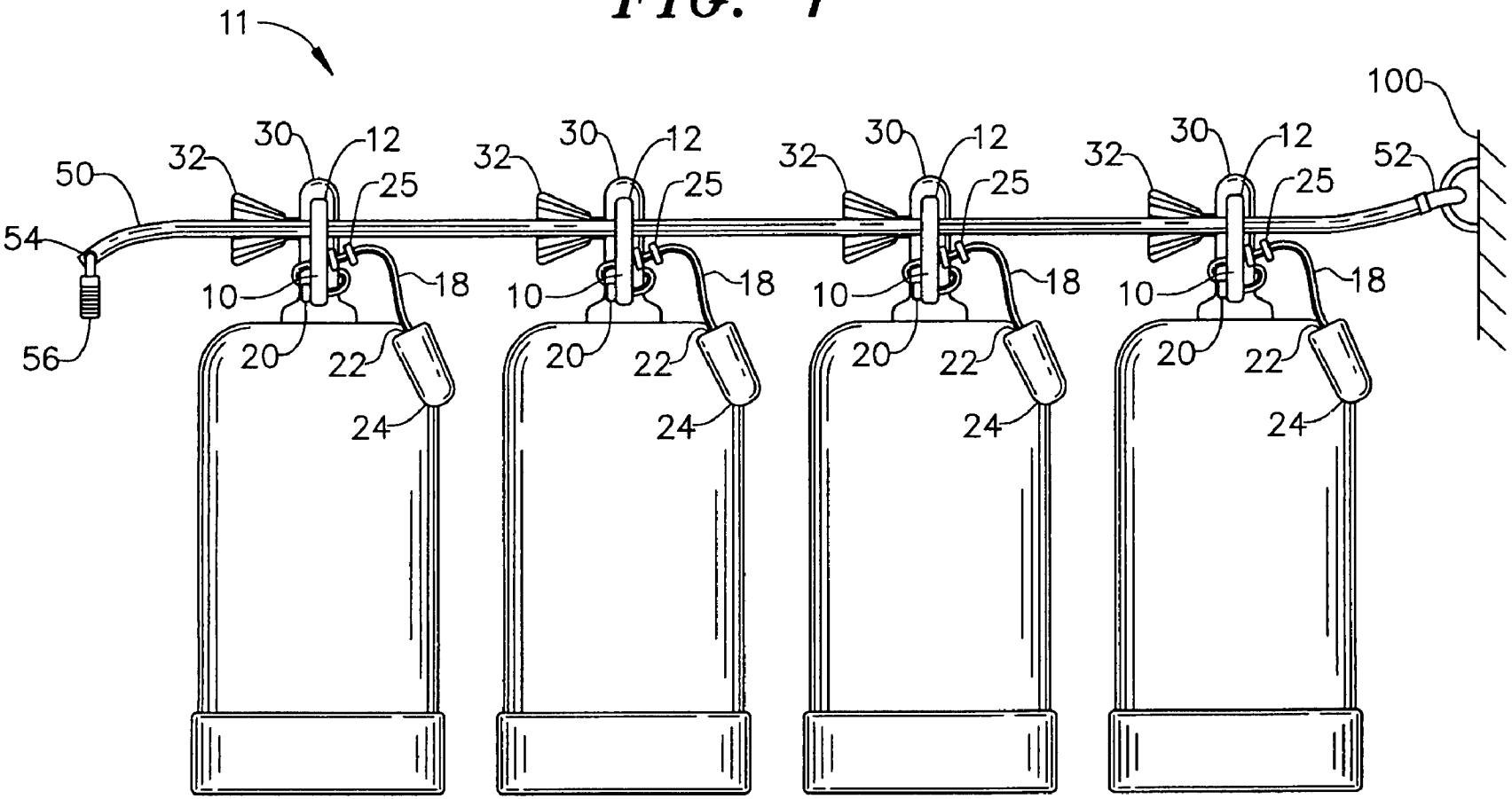
FIG. 1 is a pictorial view of four scuba tanks having a first embodiment of the locking device assembly of the instant invention secured to each tank and further secured to a fixed structure.

Now referring to FIG. 1, a locking device assembly is depicted which secures multiple scuba tanks 1–4 the tanks to a fixed structure 100. The scuba tanks consist of cylinders housing compressed air, argon, helium, nitrogen or a mix of thereof. Scuba tanks are available in several standard sizes., the larger of which is an 120 cubic foot capacity tank, 7 and ¼ inches in diameter, and approximately 26 inches high. The most common tank is 80 cubic foot having slightly smaller dimensions. At the upper end of a scuba tank there is a valve commonly called a K-valve 30. The K-valve include a rotatable knob 32 for controlling the release of gas from the tank. The K-valve is subsequently coupled to a hose and air regular that allows the diver to breath underwater is common between the various size tanks. The present invention provides a locking plate assembly 12 for each tank common to the K-valve, thus allowing tanks of various sizes to be locked with the same device.

As will be described in detail hereinafter, each tank has a locking plate assembly 10 secured thereto, through which is threaded a flexible elongated securement means which forms part of the locking device assembly. In the illustrated embodiment, the flexible elongated securement means is a conventional cable lock 50. A segment of metal link chain can also be used. The cable lock 50 has a first end 54 having an aperture for receiving the shackle bar of a conventional padlock, and a second attachment end 52 which allows the cable 50 to be attached to a stationary structure. The second attachment end 52 can be in the form of a loop through which the first end 54 can be inserted.

Figure 2A:
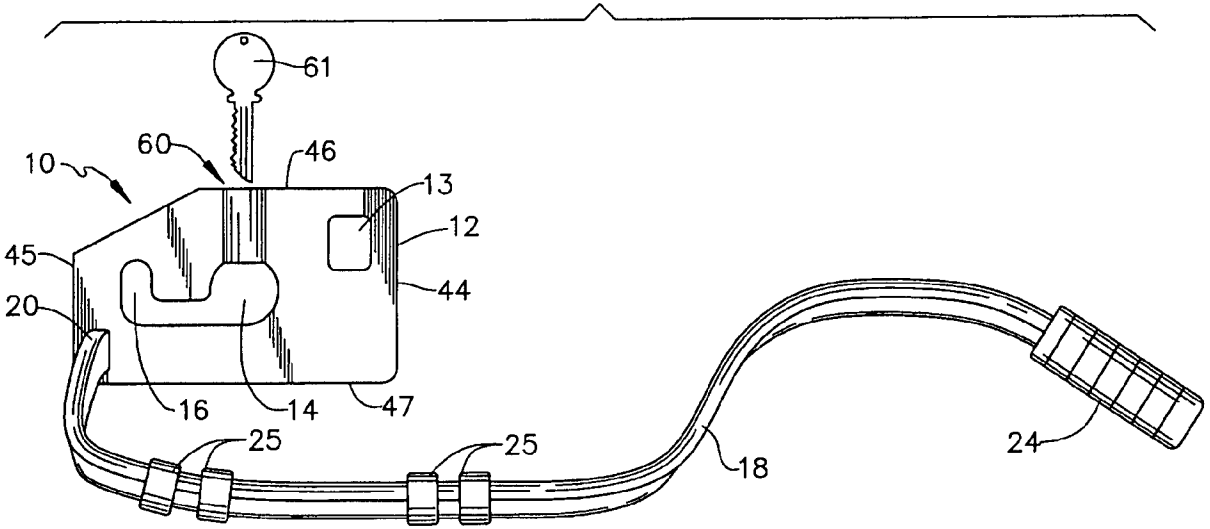
FIG. 2A is a front view of the locking plate assembly of the device of FIG. 1, in which the tumbler lock is unlocked.

The locking plate assembly 10 is shown in detail in FIGS. 2A, B and 3–4. The locking plate assembly 10 includes a locking plate 12, preferably steel, having a top edge 44, a rear edge 45 and opposing side edges 46, 47. A first aperture 13 is positioned near the top edge 44 of the locking plate 12 which is sized to receive the insertion end 54 of the cable 50 (FIG. 1). A second aperture 14 is position in the approximate center of the locking plate 12, and an elongated slot extends 16 outwardly from the second aperture 14 with the width of the elongated slot 16 being less than the width of the second aperture 14. The elongated slot 16 preferably extends toward the rear edge 45, and can have an L-shaped configuration.

Figure 3:
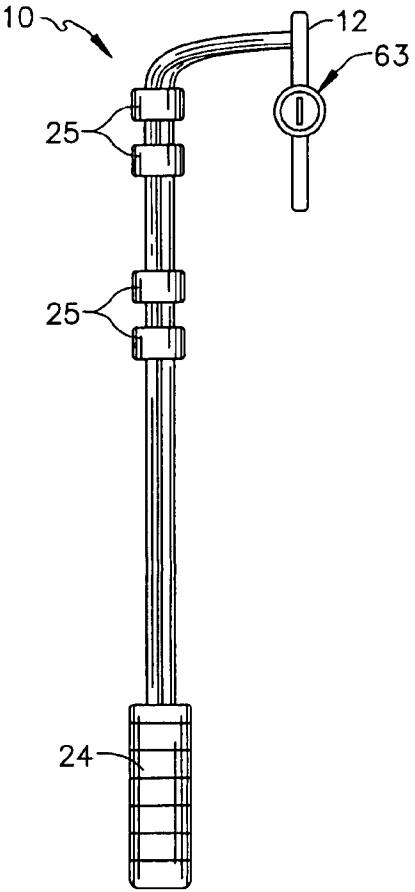
FIG. 3 is a top plan view of the locking plate assembly of the device of FIG. 1.
Figure 2B:
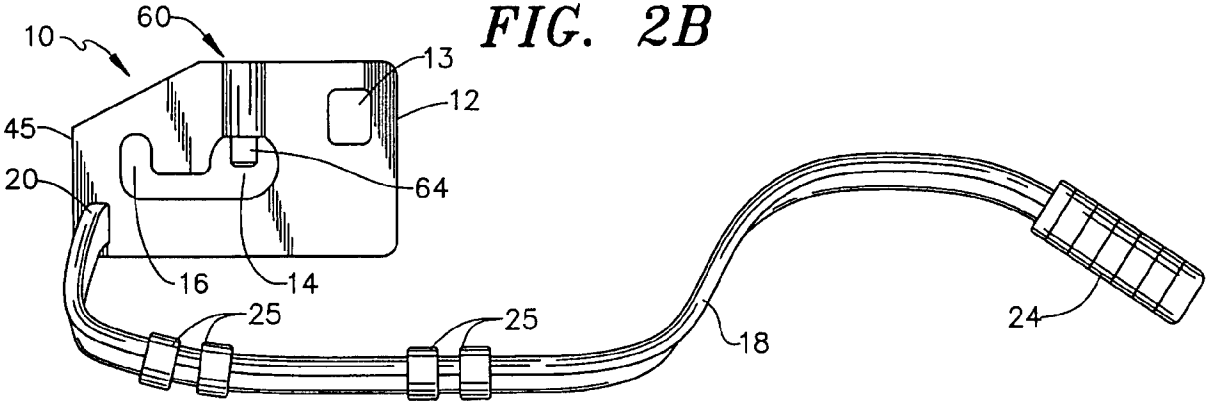
FIG. 2B is a front view of the locking plate assembly of the device of FIG. 1, in which the tumbler lock is locked.

As can be best seen in the top view shown in FIG. 3, the locking plate 12 includes a key-operated cylindrical tumbler lock 60 which is tangentially adjacent the second aperture 14. The cylindrical tumbler lock 60 includes a barrel 63 which is integrally formed with the locking plate and extends from one of the opposing side edges 46,47 to the second aperture 14. The cylindrical tumbler lock 60 is openable by means of key 61, and includes a coaxial bolt member 64 operatively associated with the key operation thereof. The bolt member 64 is positionable between locked and unlocked positions with the bolt member extending into the second aperture 14 in the locked position as shown in FIG. 2B. In the unlocked position shown in FIG. 2A, the bolt member 64 is retracted into the barrel 63 leaving the second aperture 14 open.

Figure 6:
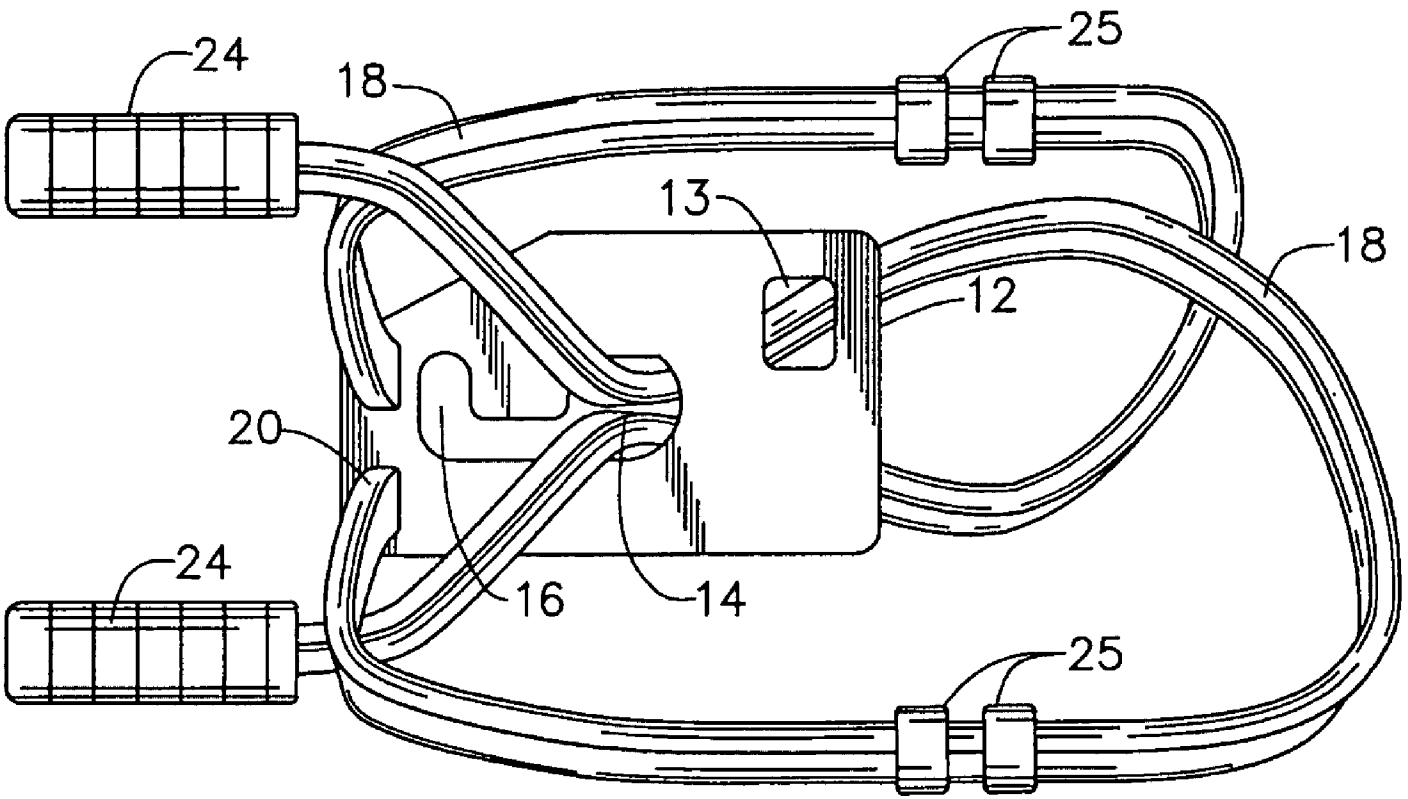
FIG. 6 is an alternative embodiment of the locking plate assembly which includes multiple attachment cables.

The locking plate assembly 10 includes at least one attachment cable 18 formed from a length of flexible steel cable having a proximal end permanently attached at a point 20 to the locking plate 12 and a distal end extending therefrom. The attachment cable 18 is sized for placement within the slot 16. The cable 18 includes a coaxially attached locking lug sized for closely aligned insertion into the second aperture 14. In the illustrated embodiment, the locking lug is in the form of a end fitting 24 which can operate as a pull handle. As shown in FIG. 6, the locking plate assembly 10 can includes multiple attachment cables 18 which are permanently attached to the locking plate 12, which each include an end fitting 24.

The flexible cable 18 is sized for placement within the slot 16 of the steel plate 12 and employs at least one cable crimp 25 which operates as a line positioner. However, multiple cable crimps 25 can be used to provide locking of the line at any number of positions and, when at least two cable crimps 25 are use, as shown, the cable can be fixed in length to prevent lengthening as well as shortening of the flexible attachment cable once placed in the slot. This is important when securing diving accessories where movement of the flexible 18 may otherwise provide a thief with the ability to dislodge an accessory. It should be noted that the proximal end 20 may be unattached wherein the flexible attachment cable 18 may be stored independently from the steel plate lock and when use is required, engage the proximal end 20 with the slot 16.

Figure 5:
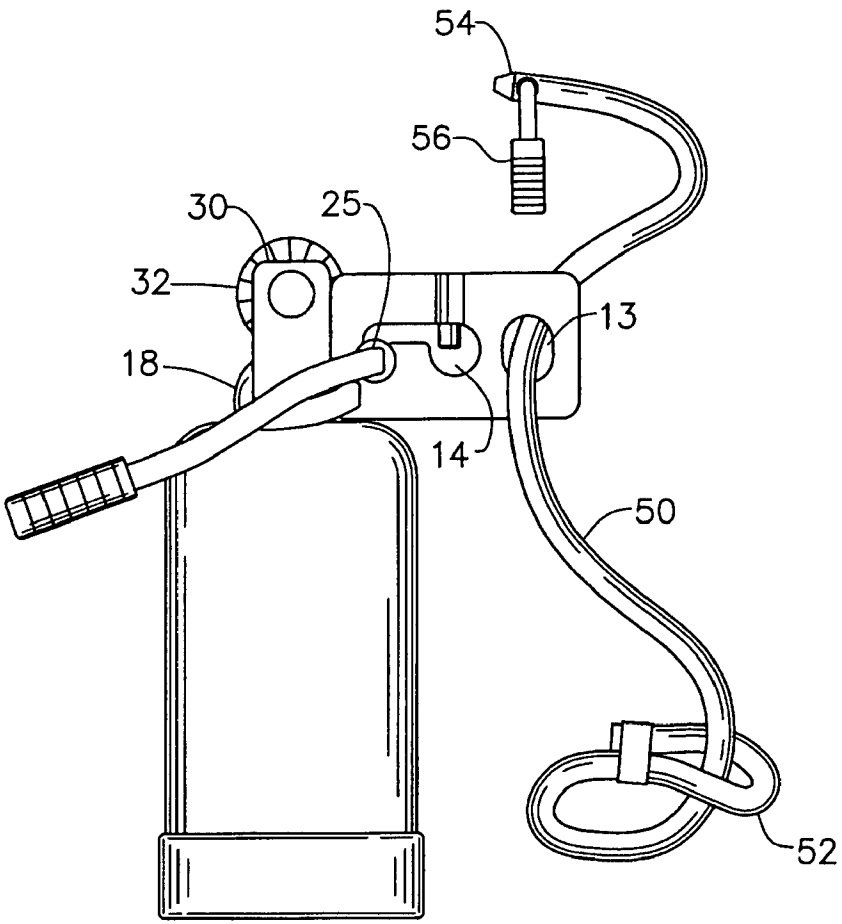
FIG. 5 is a side view of the locking plate assembly secured to a scuba tank.
Figure 4:
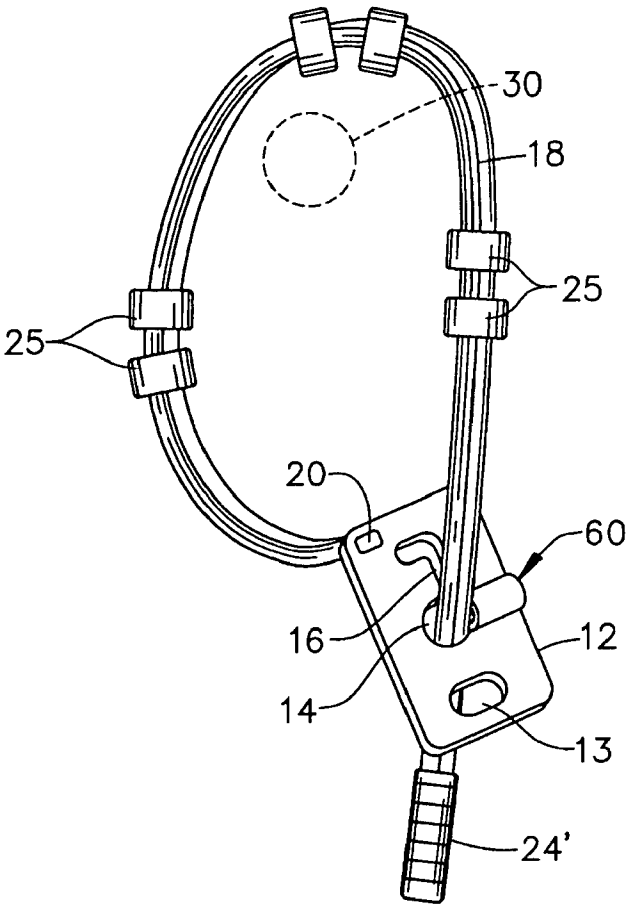
FIG. 4 illustrates the procedure for securing the locking plate assembly of the device of FIG. 1 to an item to be locked.

In operation, the bolt member 64 of the key-operated tumbler lock is placed in an unlocked position, thus leaving the second aperture 14 open. As shown in FIG. 4, the distal end of the attachment cable 18 is wrapped around the K-valve 30, and then inserted into the second aperture 14 of the locking plate 12 such that the end fitting 24 passes through the second aperture 14 and at least one crimp 25 is drawn through the aperture 14. The attachment cable 18 is then transversed for placement into the slot 16, as shown in FIG. 5. The cylindrical tumbler lock is then locked by means of a key, which locking action causes the bolt member 64 to extend downwardly into the locked position. The bolt member 64 prevents the withdrawal of the end fitting 24 or other locking lug from the second aperture 14, and the locking plate 12 is thus secured to the K-valve 30 in a locking arrangement. The cable lock 50 is secured to a stationary structure using any suitable means, and the insertion end 54 of the cable lock 50 inserted through the first aperture 13 in the locking plate 12, and a padlock 56 is secured though the aperture at the insertion end, thereby locking the scuba tank to the stationary structure. A plurality of locking plate assemblies 10 can be used to lock corresponding number of scuba tanks to the cable lock 50. The locking plate assemblies 10 of the invention advantageously allow individual scuba tanks to be selectively removed from the locking arrangement without unlocking and unthreading the entire contents residing on the cable lock 50.

In addition, it is possible to use the locking plate assemblies 10 independently of the main locking cable 50. In this arrangement, a the shackle bar of a padlock or other suitable locking device can be inserted though the first aperture 13 to secure the locking device 10 to a stationary structure having a suitable configuration.

Figure 7:
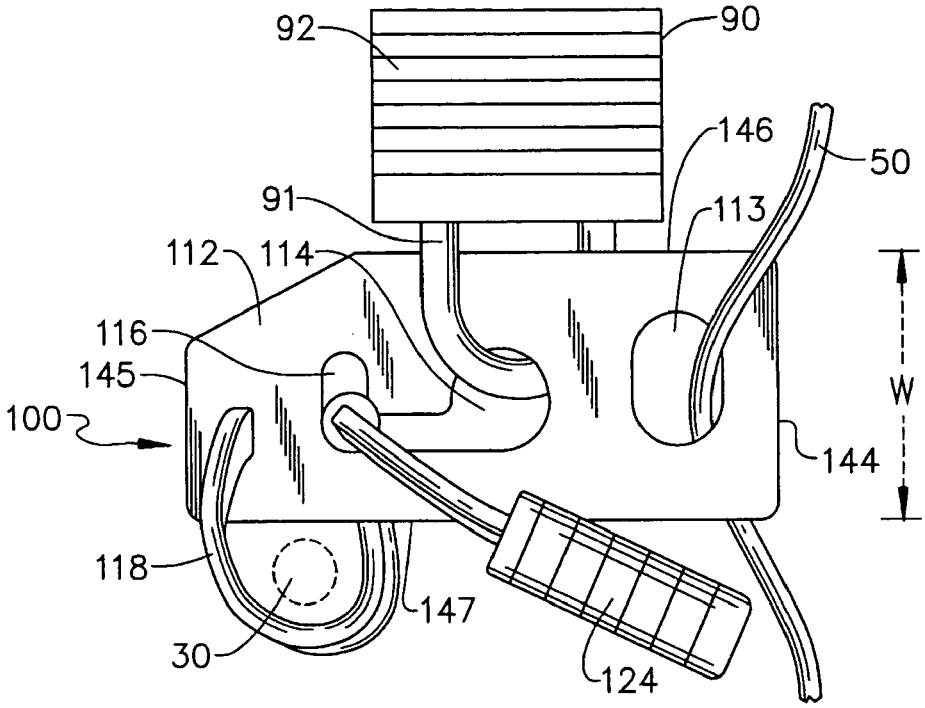
FIG. 7 is an alternative embodiment of the locking plate assembly of the invention.

FIG. 7 illustrates an alternative embodiment of the invention depicted as locking device 100. The locking device 100 includes a locking plate 112 similar to that shown in the previous embodiment. The locking plate 112 has a top edge 144, a rear edge 145 and opposing side edges 146,147. The locking plate 112 includes a first aperture 113 positioned near the top edge 144 of the locking plate 112 which is sized to receive the insertion end 54 of the cable 50 and a second aperture 114 positioned in the approximate center of the locking plate 112. An elongated slot 116 extends outwardly from the second aperture 114. The elongated slot 116 preferably extends toward the rear edge 145, and can have an L-shaped configuration. As in the previous embodiment, at least one attachment cable 118 is permanently affixed to the locking plate 112, and has an end fitting 124 coaxially attached thereto which is sized for closely aligning insertion into the second aperture 114. The cable 118 can include cable crimps 125 to guide and position the cable 118 within the slot 116.

The locking device assembly 118 includes a conventional padlock 90 having a U-shaped shackle bar 91 securable to a locking base 92. The locking device assembly 118 of the invention may include a plurality of locking plate assemblies 110 each having a corresponding padlock 90. The shackle bar 91 has a height and a width allowing it to be inserted through the second aperture 114 and secured to the base 92. The width of the locking plate 112 is dimensioned to allow the shackle bar 91 to be inserted through the second aperture 114 and locked so that said locking base is proximate one of opposing side edges 146,147. The width w of the locking plate 112 is sufficient to ensure that the shackle bar 91 cannot be manipulated into the slot 116 once the padlock 90 is locked in position.

To secure a plurality of scuba tanks using the locking device 118, a locking plate assembly 110 and corresponding padlock 90 are provided for each tank to be locked. The padlock 90 is initially unlocked and separated from the locking plate 112. The distal end of the attachment cable 118 is wrapped around a K-valve 30 of the tank, and then inserted into the second aperture 114 of the locking plate 112 such that the end fitting 124 passes through the second aperture. The attachment cable 118 is then transversed for placement into the slot 116, and the shackle bar 91 of the unlocked padlock 90 is inserted through the aperture 114 and locked to the locking base 92. The shackle bar 91 within the aperture 114 prevents the withdrawal of the end fitting 124 or other locking lug from the second aperture 114. The cable lock 50 is then inserted through the first aperture 113 and secured to a stationary structure in the same manner described in connection with the previous embodiment.

Figure 8:
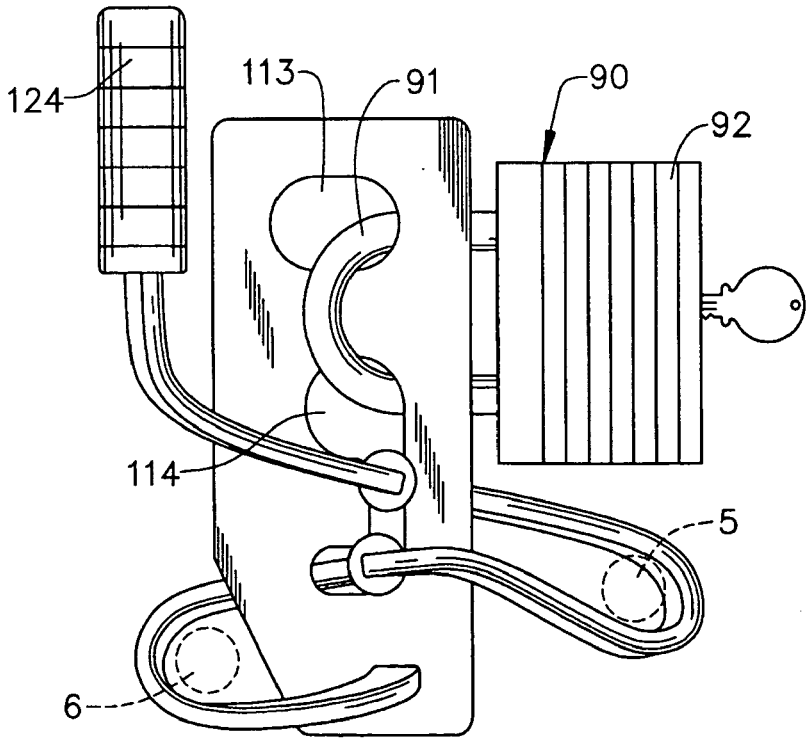
FIG. 8 illustrates an alternative mode of use for the locking plate assembly shown in FIG. 7.

In an alternate mode of use shown in FIG. 8, a single locking plate assembly 110 can be used without the cable 50 to secure a single item to a fixed structure 5 such as a fence. The attachment cable 118 is wrapped around the item to be secured 6 and the the end fitting 124 is inserted through the second aperture 114. The cable 118 is then wrapped around a fixed structure in such a way that it cannot be dislodged, and the end fitting 124 is inserted again through the second aperture 114 in the opposite direction. The shackle bar 91 of the padlock 90 is then inserted through the first and second apertures 113, 114 and locked to the locking base 92, thus preventing the withdrawal of the end fitting 124.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

I claim:

1. An accessory locking device comprising:

a flexible elongated securement means having a first end forming a lockable insertion end and a second end forming an attachment end, said lockable insertion end having an aperture receptive to the shank of a padlock, said attachment end having a attachment aperture whereby said flexible securement means can be fixedly secured to a stationary structure;

a locking plate assembly, said locking plate assembly comprising a locking plate having a first aperture sized to receive said insertion end of said securement means and a second aperture having an elongated slot extending therefrom;

a key-operated tumbler lock tangentially adjacent said second aperture, said tumbler lock including a coaxial bolt member operatively associated therewith positionable between locked and unlocked positions wherein said bolt member extends into said second aperture in said locked position; and at least one attachment cable formed from a length of flexible steel cable having a proximal end permanently attached to said locking plate and a distal end extending therefrom and sized for placement within said slot, said at least one attachment cable including a coaxially attached locking lug wherein said locking lug is sized for closely aligned insertion into said second aperture;

and a conventional padlock;

whereby said bolt member of said key-operated tumbler lock is placed in an unlocked position, and said distal end of said at least one attachment cable is wrapped around an item to be locked and inserted into said second aperture of said locking plate such that said locking lug passes through said second aperture and said at least one attachment cable is transversed for placement into said slot, whereupon said bolt member of said key-operated tumbler lock is placed in a locked position thus preventing the withdrawal of said locking lug from said second aperture, and said insertion end of said flexible elongated securement means is inserted through said first aperture leaving said insertion end available for receipt of said padlock and said attachment end is secured to a stationary structure, thereby locking the item to the stationary structure.

2. The accessory locking device of claim 1, wherein said flexible elongated securement means is a conventional cable lock.

3. The accessory locking device of claim 1, wherein said flexible elongated securement means is a segment of metal link chain.

4. The accessory locking device of claim 1, wherein said locking lug is positioned at the distal end of said attachment cable.

5. The accessory locking device of claim 4, wherein said locking lug is formed as a handle whereby said handle facilitates grasping the flexible cable and positioning thereof.

6. The accessory locking device of claim 1, further comprising two spaced apart cable crimps coaxially positioned on said at least one attachment cable whereby said attachment cable is inserted into said slot such that said cable crimps are on either side of said slot.

7. The accessory locking device of claim 1, wherein said locking plate is a steel plate.

8. The accessory locking device of claim 1, wherein said slot is L-shaped.

9. The accessory locking device of claim 1, wherein said at least one attachment cable comprises a plurality of cables.

10. The accessory locking device of claim 1, further comprising a handle positioned at said distal end of said attachment cable whereby said handle facilitates grasping the flexible cable and positioning thereof.

11. An accessory locking device comprising:

a flexible elongated securement means having a first end forming a lockable insertion end and a second end forming an attachment end, said lockable insertion end having an aperture receptive to the shank of a padlock, said attachment end having a attachment aperture whereby said flexible securement means can be fixedly secured to a stationary structure;

a first conventional padlock having a U-shaped shackle bar having a height and a width securable to a locking base;

a locking plate assembly, comprising:

a locking plate having a forward edge, a rearward edge and opposing side edges defining a length and a width; said locking plate having a first aperture proximate said forward edge sized to receive said insertion end of said securement means and a second aperture positioned approximately in the center of said locking plate, said second aperture having an elongated slot extending therefrom toward said rearward edge and substantially parallel to said opposing side edges, said width of said locking plate being dimensioned to allow said shackle bar of said padlock to be inserted through said second aperture and secured to said locking base such that said locking base is closely positioned to one of said opposing side edges when said shackle bar is locked to said locking base; and at least one attachment cable formed from a length of flexible steel cable having a proximal end permanently attached to said plate and a distal end extending therefrom and sized for placement within said slot, said at least one attachment cable including a coaxially attached locking lug wherein said locking lug is sized for closely aligned insertion into said second aperture;

and a second conventional padlock securable to said insertion end of said elongated securement means;

whereby said distal end of said at least one attachment cable is wrapped around an item to be locked and inserted into said second aperture of said locking plate such that said locking lug passes through said second aperture and said at least one attachment cable is transversed for placement into said slot, whereupon said shackle bar of said first padlock is inserted through said second aperture with said locking base positioned proximate one of said opposing side edges and said shackle bar secured thereto, the shackle bar of said first padlock thus preventing the withdrawal of said locking lug from said second aperture, and said insertion end of said flexible elongated securement means is inserted through said first aperture leaving said insertion end available for receipt of said second padlock and said attachment end is secured to a stationary structure, thereby locking the item to the stationary structure.

12. The accessory locking device of claim 11, wherein said flexible elongated securement means is a conventional cable lock.

13. The accessory locking device of claim 11, wherein said flexible elongated securement means is a segment of metal link chain.

14. The accessory locking device of claim 11, wherein said locking lug is positioned at the distal end of said attachment cable.

15. The accessory locking device of claim 14, wherein said locking lug is formed as a handle whereby said handle facilitates grasping the flexible cable and positioning thereof.

16. The accessory locking device of claim 11, further comprising two spaced apart cable crimps coaxially positioned on said at least one attachment cable whereby said attachment cable is inserted into said slot such that said cable crimps are on either side of said slot.

17. The accessory locking device of claim 11, wherein said locking plate is a steel plate.

18. The accessory locking device of claim 11, wherein said slot is L-shaped.

19. The accessory locking device of claim 11, wherein said at least one attachment cable comprises a plurality of cables.

20. The accessory locking device of claim 11, wherein said width of said locking plate is selected so that the minimum distance between said opposing side edges and said second aperture is less that the height of said shackle of said first pad lock, the width being further selected to provide close engagement between said locking plate and said first padlock when the shackle bar of the first padlock is inserted through the second aperture and secured to said locking base, whereby manual manipulation of said shackle bar into said slot is thus prohibited.

21. The accessory locking device of claim 11, further comprising a handle positioned at said distal end of said attachment cable whereby said handle facilitates grasping the flexible cable and positioning thereof.

* * * * *